US010054315B2

(12) United States Patent
Choi

(10) Patent No.: US 10,054,315 B2
(45) Date of Patent: Aug. 21, 2018

(54) COOKING APPLIANCE

(71) Applicant: LG ELECTRONICS INC., Seoul (KR)

(72) Inventor: Moonho Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 261 days.

(21) Appl. No.: 14/859,537

(22) Filed: Sep. 21, 2015

(65) Prior Publication Data

US 2016/0097541 A1 Apr. 7, 2016

(30) Foreign Application Priority Data

Oct. 7, 2014 (KR) ..... 10-2014-0134770

(51) Int. Cl.

| | |
|---|---|
| ***F24C 3/12*** | (2006.01) |
| ***G05G 1/08*** | (2006.01) |
| *F23N 1/00* | (2006.01) |
| *G05G 1/12* | (2006.01) |
| *G05G 23/02* | (2006.01) |

(52) U.S. Cl.

CPC ..... *F24C 3/126* (2013.01); *F24C 3/124* (2013.01); *G05G 1/08* (2013.01); *G05G 2700/20* (2013.01)

(58) Field of Classification Search

CPC ..... F24C 3/126; F24C 3/124; G05G 1/08; G05G 1/12; G05G 1/10; G05G 2700/20; G05G 23/02; A21B 1/33; A47J 37/0674; F23N 1/007

USPC ..... 126/39 E, 37 R, 50

See application file for complete search history.

(56) References Cited

U.S. PATENT DOCUMENTS 1,969,163 A * 8/1934 Stevenson ..... F24C 3/126 126/39 H
2,429,900 A * 10/1947 Spraragen ..... G05G 1/08 192/223.2
2,429,901 A * 10/1947 Spraragen ..... G05G 1/08 192/223.2

(Continued)

FOREIGN PATENT DOCUMENTS

JP 2008-64221 A 3/2008
JP 2010-3472 A 1/2010

(Continued)

OTHER PUBLICATIONS

Korean Notice of Allowance dated Feb. 24, 2016. (English Translation).

*Primary Examiner* — Gregory Huson
*Assistant Examiner* — Daniel E Namay
(74) *Attorney, Agent, or Firm* — Ked & Associates LLP

(57) ABSTRACT

A cooking appliance may include a cabinet that forms an outer appearance, at least one cooking device provided in the cabinet to cook items using a gas flame, a panel formed with at least one through-hole, a gas valve provided behind the panel and including a valve shaft that penetrates the at least one through-hole and extends in a forward direction from the panel, a knob provided in front of the panel to be connected with the valve shaft to cause rotation and forward-backward movement of the valve shaft through a user's manipulation, and a bearing secured between the knob and the panel to support a circumference of the valve shaft in order to prevent restriction of movement of the knob and the valve shaft.

25 Claims, 10 Drawing Sheets

(56) References Cited

U.S. PATENT DOCUMENTS 2,849,891 A * 9/1958 Mills ..... F24C 3/124 126/42
3,169,505 A * 2/1965 Spraragen ..... G05G 1/10 116/230
3,699,789 A * 10/1972 Potzick ..... E05B 37/04 200/308
4,232,980 A * 11/1980 Tertinek ..... E04F 21/248 192/129 R
4,488,689 A * 12/1984 Councilman ..... A01K 89/027 242/245
4,572,154 A * 2/1986 Schweitzer ..... F24C 3/085 126/214 R
4,738,410 A * 4/1988 Yamaguchi ..... A01K 89/0111 242/271
4,796,828 A * 1/1989 Councilman ..... A01K 89/027 242/245
5,003,802 A * 4/1991 Beatty ..... E05B 37/08 70/327
5,094,259 A * 3/1992 Hsu ..... F23N 5/123 137/614.11
5,134,898 A * 8/1992 Anderson ..... G05G 1/08 74/527
6,180,901 B1 * 1/2001 Bauer ..... H01H 1/16 200/11 R
6,404,354 B1 * 6/2002 Decker ..... G05G 1/08 200/318
7,156,370 B2 * 1/2007 Albizuri ..... F16K 5/0214 126/39 E
9,074,389 B2 * 7/2015 Shimizu ..... E05D 1/04
2003/0159689 A1 * 8/2003 Huang ..... A47J 37/0713 126/39 E
2004/0177842 A1 * 9/2004 Larsen ..... F24C 3/087 126/41 R
2004/0231445 A1 * 11/2004 Marcus ..... F16H 55/24 74/425
2005/0045172 A1 * 3/2005 Pianezze ..... F24C 3/103 126/39 BA
2006/0175566 A1 * 8/2006 Albizuri ..... F16K 5/0214 251/207
2009/0151505 A1 * 6/2009 Castillo ..... G05G 1/12 74/553
2011/0005508 A1 * 1/2011 Albizuri ..... F16K 5/0214 126/39 E
2011/0146650 A1 * 6/2011 Karamatic ..... F24C 7/082 126/42
2012/0305820 A1 * 12/2012 Bollman ..... F24C 3/126 251/213
2014/0150505 A1 * 6/2014 Shimizu ..... E05D 1/04 70/344
2015/0153048 A1 * 6/2015 Moro ..... F23N 5/107 99/332

FOREIGN PATENT DOCUMENTS

KR 10-2007-0065611 A 6/2007
KR 20-2010-0003740 4/2010

* cited by examiner

COOKING APPLIANCE

CROSS-REFERENCE TO RELATED APPLICATION(S)

This application claims the benefit of Korean Patent Application No. 10-2014-0134770, filed in Korea on Oct. 7, 2014, which is hereby incorporated by reference as if fully set forth herein.

BACKGROUND

1. Field

A cooking appliance is disclosed herein.

2. Background

In general, cooking appliances are a kind of household or indoor appliance used to cook food or other items (hereinafter, collectively referred to as "food") using electricity or other forms of energy. Cooking appliances using gas as a heat source may include a gas range, a gas oven, and a gas oven range, for example. That is, various cooking appliances to cook food using gas combustion are provided.

FIG. 1 is a side view illustrating a general gas oven range as an example of a cooking appliance. As shown FIG. 1, a cooking appliance 10 or a gas oven range includes a cabinet 20 that forms an outer appearance of the cooking appliance. The cabinet 20 may have a chamber 25 formed thereinside in order to accommodate food to be cooked therein. The chamber 25 may be removed or separated from a gas range.

A cook-top 26 may be provided at a top of the cabinet 20 on which containers used for cooking may be placed. While a container, such as a pot, is placed on the cook-top 26, food may be cooked by a gas flame generated below the cook-top 26.

Such a chamber 25 or cook-top 26 may be referred to as a cooking unit or device, which cooks food using heat from a gas flame. Various cooking devices may be provided according to a type of cooking appliance. For example, cooking devices that cook food directly using a gas flame or using radiation or convection from a gas flame may be provided. The cook-top 26 may be an example of a cooking device that directly uses a gas flame, and the chamber 25 may be an example of a cooking device that uses heat radiation or convection from a gas flame.

A door 50 may be provided at a front portion of the cabinet 20 in order to open and close the chamber 25, and a door handle 60 may be provided at or on the door 50. A user may open and close the door 50 using the door handle 60.

The cooking appliance 10 may include a panel 30, which may be integrally formed with the cabinet 20 or removably coupled to the cabinet 20. Various manipulation units or devices, through which a user may manipulate the cooking appliance 10, may be provided at the panel 30.

The manipulation devices may function to enable a user to ignite or extinguish gas or adjust a flame intensity. The manipulation devices may include a timer, and a display unit or display to show cooking information or a current operational state of the cooking appliance 10.

In the case of a cooking appliance using gas, the panel 30 may be provided with a knob 40. The knob 40 may be referred to as a manipulation device, through which a user may ignite gas at a specific position.

For example, a user may manipulate the knob 40 in order to ignite gas in the chamber 25 or ignite gas at a specific one of a plurality of cook-tops. Therefore, the cooking appliance typically includes a plurality of knobs as the manipulation devices.

The knob 40 is generally connected with a valve shaft (not shown, refer to FIG. 4) of a gas valve (not shown, refer to FIG. 4), which is located behind the panel 30. The knob 40 is generally configured to move forward and rotate in order to ignite gas. In other words, because it is dangerous to use a gas flame, the knob may be configured so as to necessarily be driven by two movements in the interest of safety. In particular, in order to prevent children from easily manipulating the knob, household gas appliances may adopt a push and turn mechanism. The two movements of the knob 40 are transmitted to the gas valve through the valve shaft, thereby igniting gas in the chamber or at the desired cook-top.

The forward movement of the valve shaft is for generating a spark using electricity, and the rotation of the valve shaft is for supplying gas. As a result, the spark ignites the gas.

As shown in the drawings, the panel 30 may be disposed on the front portion or the top portion of the cabinet 20. Further, the panel 30, as shown in FIG. 1, may be arranged at an incline, or may be arranged vertically. Therefore, a position or posture of the knob 40 may be changed based on a position or shape of the panel 30.

As described above, gas ignition requires forward-backward movement and rotation of the valve shaft. In order to extinguish the gas, the valve shaft may be rotated in the reverse direction to close the gas valve.

Recently, with the demands of high safety and improved aesthetic appearance, cooking appliances equipped with a knob made from an aluminum material or zinc material have been manufactured. If the knob 40 is made from a metal material, an outer appearance of the cooking appliance is aesthetically improved by virtue of its metallic gloss, and a weight of the knob 40 is increased, thereby preventing children from easily manipulating the knob 40.

In many cases, the knob 40 is substantially vertically arranged on the front portion of the cooking appliance. This means that the valve shaft is substantially horizontally arranged. Therefore, there is a high risk that the valve shaft may become deformed or eccentrically biased, which may lead to restriction of forward-backward movement or rotation of the valve shaft.

Restriction of movement of the valve shaft may frequently occur when the knob 40 is relatively heavy, and may more frequently occur especially when the valve shaft is arranged substantially horizontally. This is because a higher bending moment may be applied to the valve shaft due to the weight of the knob 40.

In a case in which a knob-ring (refer to an embodiment of the present application described hereinafter) is used, movement of the knob 40 may be restricted by the knob-ring. This restriction may also occur when the valve shaft is deformed or eccentrically biased. It is necessary to devise a cooking appliance capable of preventing restriction of movement of the knob or the valve shaft.

BRIEF DESCRIPTION OF THE DRAWINGS

Embodiments will be described in detail with reference to the following drawings in which like reference numerals refer to like elements, and wherein.

DETAILED DESCRIPTION

Figure 1:
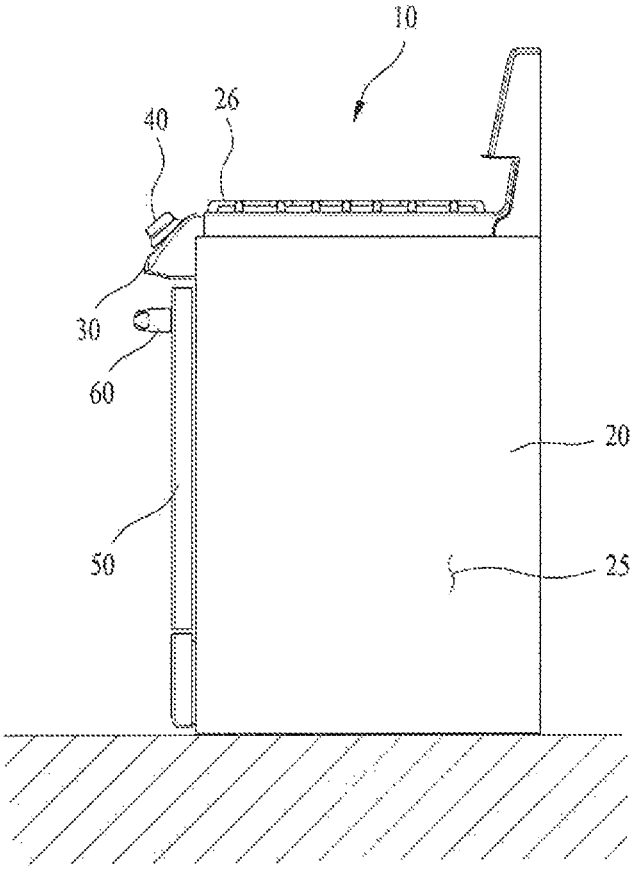
FIG. 1 RELATED ART
FIG. 1 is a side view of a general gas oven range as an example of a cooking appliance.

Reference will now be made in detail to embodiments, examples of which are illustrated in the accompanying drawings. The embodiments described in the specification and shown in the drawings are illustrative only and are not intended to represent all aspects. Wherever possible, the same or like reference numbers have been used throughout the drawings to refer to the same or like parts. In the drawings, a component's size, and shape are exaggerated for clarity and convenience.

Figure 2:
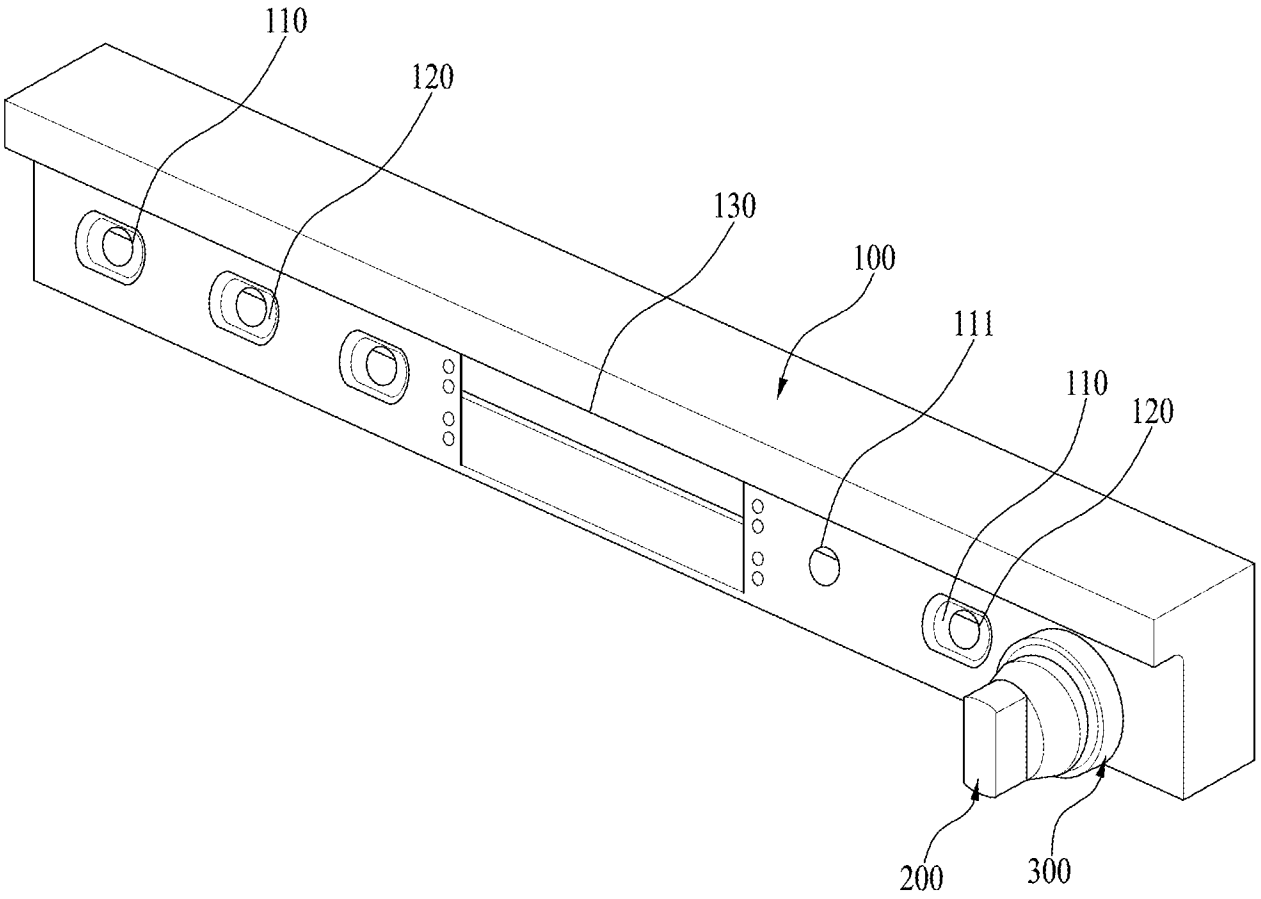
FIG. 2 is a perspective view illustrating a panel, which may be applied to a conventional cooking appliance or to a cooking appliance, according to an embodiment.

FIG. 2 is a perspective view illustrating a panel, which may be applied to of a conventional cooking appliance to a cooking appliance, according to an embodiment. For convenience of explanation, illustration of components, such as a cabinet, and a cooking unit or device, for example, has been omitted in the drawings. A front appearance of the panel of the cooking appliance according to an embodiment may be identical or similar to that of the conventional cooking appliance.

A panel 100 illustrated in the drawings may be applied to a gas oven range, and may also be applied to a gas range or a gas oven in a similar way. Hereinafter, embodiments of a gas oven range as an example of a cooking appliance will be described.

The panel 100 may include a plurality of through-holes 110, each of which may corresponds to a knob 200. Accordingly, a plurality of knobs 200 may be provided at the panel 100. The illustrated panel 100 may have knobs 200 for four cook-tops and one oven, for example. In addition, the panel 100 may be formed with a timer through-hole 111. An identical or similar knob may also be provided in the timer through-hole 111. The panel 100 may be provided with a window 130, in which a display may be mounted.

A recess 120 may be formed around each through-hole 110. The recess 120 may be a concave portion of the panel 100. The through-hole 110 may be located within the recess 120. The through-hole 110 may be located at a center of the recess 120. The recess 120 may be a structure in which a gasket may be seated, which will be described hereinafter. The gasket may function to prevent foreign materials from entering the through-hole 110.

A knob-ring 300 may be provided between the knob 200 and the panel 100. The knob-ring 300 may be in close contact with the panel 100, thereby primarily preventing moisture or foreign materials from entering the through-hole 110. A portion of the knob 200 may be accommodated in or at a front portion of the knob-ring 300. That is, a portion of the knob 200 may be inserted into the knob-ring 300. Accordingly, the knob 200 may move in forward and backward directions and rotate with respect to the knob-ring 300. The knob-ring 300, arranged around the knob 200, may protect the knob 200 and prevent moisture or foreign materials from entering the panel 100 through the knob 200.

Hereinafter, the cooking appliance according to an embodiment will be described with reference to FIGS. 3 and 4.

Figure 3:
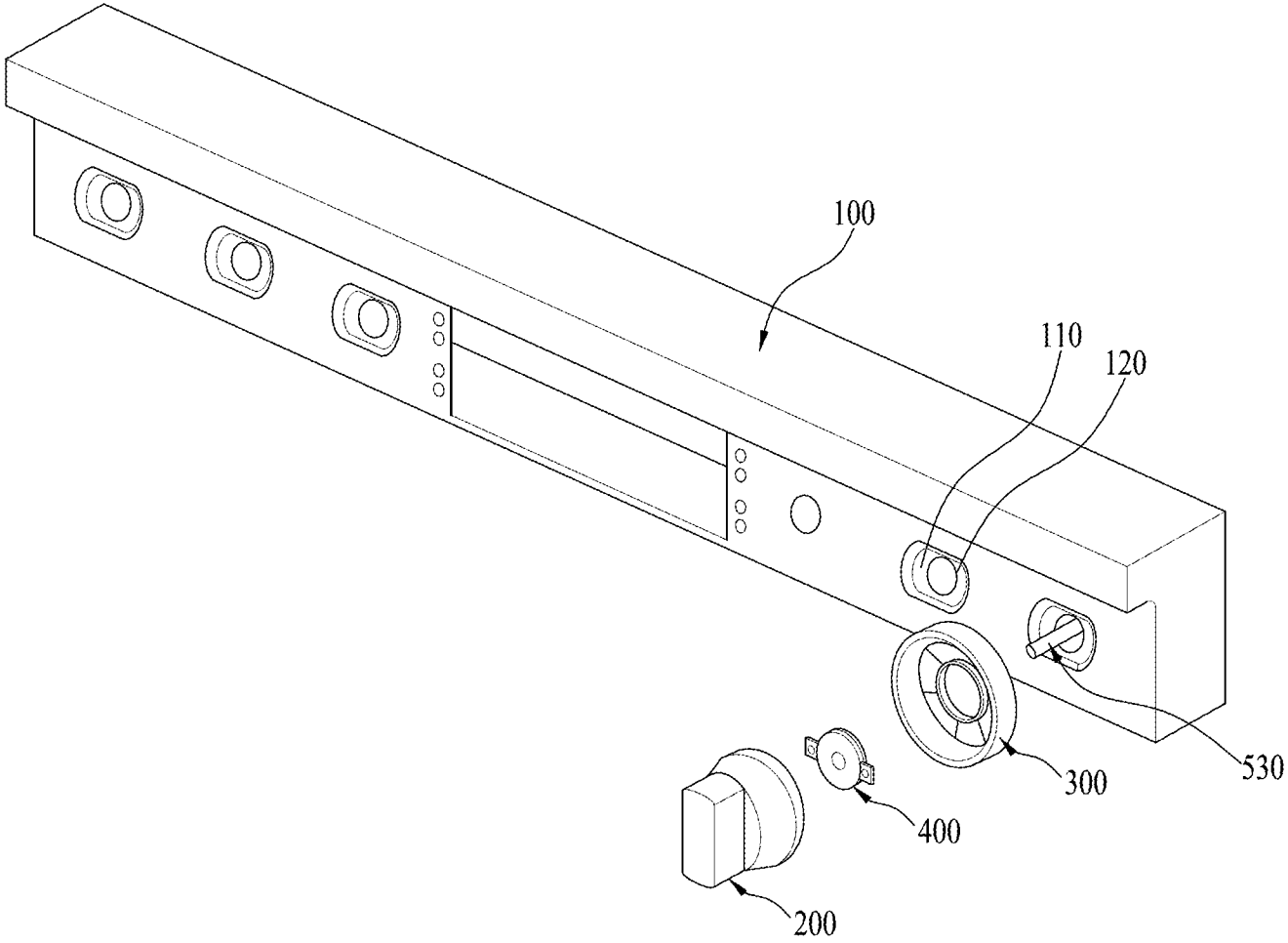
FIG. 3 is an exploded perspective view illustrating a state in which a knob is removed from a panel according to an embodiment.

FIG. 3 is an exploded perspective view illustrating a state in which a knob is removed from a panel according to an embodiment. FIG. 4 is a sectional perspective view illustrating a panel and a knob according to an embodiment. That is, FIG. 3 is an exploded perspective view illustrating a state in which the knob 200 and the knob-ring 300 are removed from the panel 100 depicted in FIG. 2. Unlike the conventional structure, this embodiment may effectively prevent restriction of movement of a valve shaft using a bearing 400. Further, restriction of movement of the knob 200 due to the knob-ring 300 may be effectively prevented. FIG. 4 illustrates a longitudinal section of a state in which the panel 100 and the knob 200 are assembled.

A gas valve 500 may be provided behind the panel 100 or in the cabinet. The gas valve 500 may include an inlet hole 510, through which gas may be introduced, and an outlet hole 520, through which gas may be discharged. The inlet hole 510 and the outlet hole 520 may be located in different surfaces of a main body 505 of the gas valve 500. For example, if the inlet hole 510 is formed in a top surface of the main body 505, the outlet hole 520 may be formed in a rear surface of the main body 505. As the gas valve 500, in particular a structure and connecting relationship between a gas valve and a gas burner, is well known in the art, a detailed explanation thereof has been omitted.

A valve shaft 530 may be provided at a front surface of the main body 505, and may extend in a forward direction. The valve shaft 530 may extend in the forward direction from the main body 505 from an inside of the main body 505. The main body 505 may include a shaft accommodating portion 540 that surrounds a portion of the valve shaft 530. The shaft accommodating portion 540 may have a hollow shape, and thus, the valve shaft 530 may extend in the forward direction through the shaft accommodating portion 540.

The valve shaft 530 may extend in the forward direction from the panel 100 through the through-hole 110. The valve shaft 530 may be coupled to the knob 200 in front of the panel 100.

The knob 200 may be formed with a shaft coupling portion 210 in which the valve shaft 530 may be coupled. The shaft coupling portion 210 may be located at a center of the knob 200. A front end portion 550 of the valve shaft 530 may be press-fitted into the shaft coupling portion 210. The shaft coupling portion 210 may include a press-fitting hole 211, in which the front end portion 550 of the valve shaft 530 may be press-fitted.

The valve shaft 530 may be divided into a rear end portion 570, a middle portion 560, and the front end portion 550. The rear end portion 570 may be a portion that passes through the hollow shaft accommodating portion 540. That is, it may be a portion which may connected with the main body 505 of the gas valve 500. The rear end portion 570 may have a circle-shaped cross section.

The front end portion 550 may be a portion which may be coupled to the knob 200. The front end portion 550 may have a cross section which may be formed in a partially-cut circle shape, that is, a "D" shape. The press-fitting hole 211 of the shaft coupling portion 210 may have a cross section which may be formed in a shape matching the shape of the cross section of the front end portion 550. Accordingly, rotational movement of the knob 200 may be transmitted to the valve shaft 530. In other words, rotational slippage between the knob 200 and the valve shaft 530 may be prevented. Besides the above cross-sectional shape, various key structures may be added.

The middle portion 560 may be a portion which may be located between the rear end portion 570 and the front end portion 550. The middle portion 560 may have a circle-shaped cross section. The middle portion 560 may be supported by the bearing 400, which will be described hereinafter.

The knob-ring 300 may be provided between the knob 200 and the panel 100. Without the knob-ring 300, external moisture or foreign materials might be introduced onto the valve shaft 530 or into the press-fitting hole 211 of the knob 200. This is because the knob 200 must be fundamentally spaced apart from the panel 100. In other words, a predetermined distance, by which the knob 200 moves toward the panel 100, must be secured. Therefore, a large amount of foreign materials may be introduced through a gap between the knob 200 and the panel 100, and such a gap may deteriorate an overall aesthetic appearance.

For these reasons, the knob-ring 300 may be provided between the knob 200 and the panel 100. The knob-ring 300 may function to isolate the gap between the knob 200 and the panel 100 from the outside. The knob-ring 300 may further function to guide forward-backward movement and rotational movement of the knob 200. Therefore, the knob 200 may be more stably and securely coupled to the panel 100.

However, a connecting relationship between the knob 200 and the knob-ring 300 may cause a problem in that movement of the knob 200 may be restricted by the knob-ring 300. As shown in FIG. 4, a rear portion of the knob 200 may be at least partially accommodated in the knob-ring 300 through a front portion, that is, an opening, of the knob 300. Accordingly, a portion of the knob 200 may always be located in the knob-ring 300. In this state, the knob 200 must be able to move forward and backward and rotate in both directions, with respect to the knob-ring 300.

Restriction of movement of the knob 200 due to the knob-ring 300 may be caused by an eccentric bias of the knob 200. The eccentric bias of the knob 200 may be caused by an eccentric bias or deformation of the valve shaft 530 coupled to the knob 200.

The knob 200 may be a manipulation unit or device, through which a user may operate the cooking appliance, and various kinds of forces, including a torque, a pushing force, and a pulling force, for example, may be applied to the knob 200. Basically, a bending moment may be applied to the valve shaft 530 due to a weight of the knob 200. If the knob 200 is made from an aluminum material or zinc material, the weight of the knob 200 may be further increased.

In addition to the weight of the knob 200, there may occur a situation in which a user pushes the knob 200 in any direction. Further, when a user moves something, it may unexpectedly collide with the knob 200, which may result in a large impact on the knob 200. The eccentric bias of the valve shaft 530 may also happen during a process of mounting the gas valve 500.

For these reasons, deformation or eccentric bias of the valve shaft 530 may happen. Such deformation or eccentric bias of the valve shaft 530 may cause restriction of movement of the knob 200 due to the knob-ring 300 or restriction of movement of the valve shaft 530 due to the shaft accommodating portion 540.

Further, deformation or eccentric bias of the valve shaft 530 may cause deformation of a gasket (described hereinafter), which may increase a frictional force between the valve shaft 530 and the gasket. The increase in frictional force may cause restriction of movement of the valve shaft 530. More specifically, there may occur a problem in that the knob 200 and the valve shaft 530, having moved forward, do not return to their original positions.

In order to prevent restriction of movement of the valve shaft 530 and/or knob 200, this embodiment may include the bearing 400. The bearing 400 may function to minimize deformation or eccentric bias of the valve shaft 530, or may function to prevent restriction of movement even if deformation or eccentric bias occurs.

The bearing 400 may function to support the valve shaft 530 with respect to the panel 100. In particular, the bearing 400 may support the valve shaft 530 so that the valve shaft 530 may move forward and backward and rotate with respect to the panel 100. Therefore, the bearing 400 may form a support point for the valve shaft 530.

More particularly, the support point of the bearing 400 for the valve shaft 530 may be located in front of the panel 100. For example, the support point of the bearing 400 may be located in front of the through-hole 110.

The valve shaft 530 may be a cantilever that extends from the main body 505 of the gas valve 500. A first end of the valve shaft 530 may be secured to the main body 505, and a second end may pass through the through-hole 110 and may act as a free end in front of the panel 100. A bending moment may be proportional to a distance from the support point. A force by which the bending moment is applied to the valve shaft 530 may be mostly exerted on the second end, that is, the front end portion 550, of the valve shaft 530. Accordingly, the support point may be located in front of the through-hole 110 and as closely to the front end portion 550 of the valve shaft 530 as possible.

For this reason, the bearing 400 may be located in the knob-ring 300. For example, the bearing 400 may be located at a center of the knob-ring 300. The bearing 400 may be secured to the knob-ring 300, and the knob-ring 300 may be secured to the panel 100. That is, the bearing 400 may be secured to the panel 100 through the knob-ring 300.

Accordingly, the support point for the valve shaft 530 may be located in front of the panel 100, and thus, a distance between an acting point due to the weight of the knob 200 and the support point of the bearing 400 may be reduced. As a result, deformation of the valve shaft 530 may be minimized.

Meanwhile, as the distance between the support point of the bearing 400 and the panel 100 is increased, a distance by which the knob 200 protrudes from the panel 100 may also be increased. This means an increase in length of the valve shaft 530. By locating the bearing 400 in the knob-ring 300, an unnecessary increase in length of the valve shaft 530 may be prevented.

Figure 4:
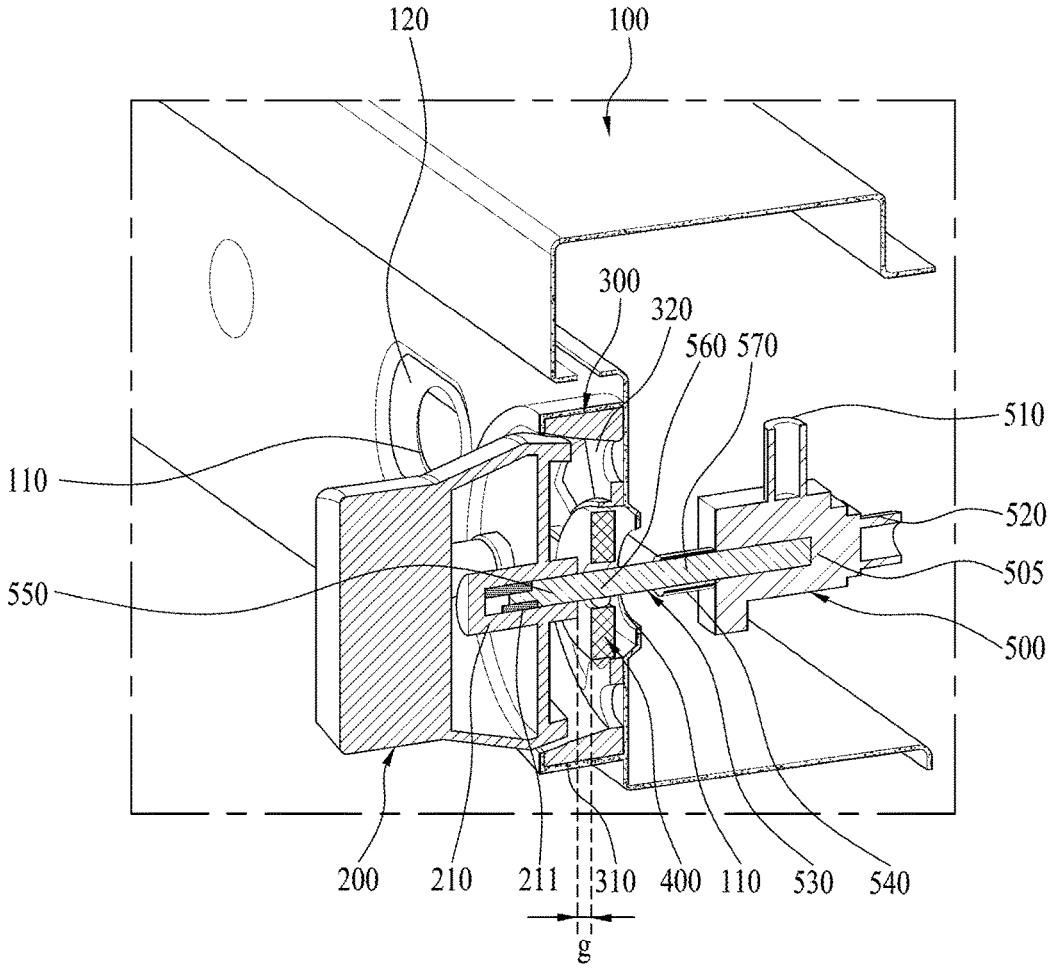
FIG. 4 is a sectional perspective view illustrating a panel and a knob according to an embodiment.

As shown in FIG. 4, a predetermined gap g may be formed between a rear end surface of the shaft coupling portion 210 and the bearing 400. The gap g may be formed between the rear end surface of the shaft coupling portion 210 and a front surface 417 (refer to FIG. 7) of the bearing 400. The gap g may refer to a distance by which the knob 200 and the valve shaft 530 may move forward. In addition, the knob 200 may be prevented from moving forward beyond the gap g.

The shaft coupling portion 210 may have an outer diameter larger than an outer diameter of the valve shaft 530. Therefore, a surface of the shaft coupling portion 210, which opposes the front surface 417 (refer to FIG. 7) of the bearing 400, may be relatively large. Accordingly, even when a user pushes the knob 200 with a relatively large force, the knob 200 may be prevented from being dislocated. Further, dislocation of the knob 200 may be prevented by a connection structure between the knob-ring 300 and the knob 200, as well as a relationship between the shaft coupling portion 210 and the bearing 400, which will be described hereinafter.

Figure 5:
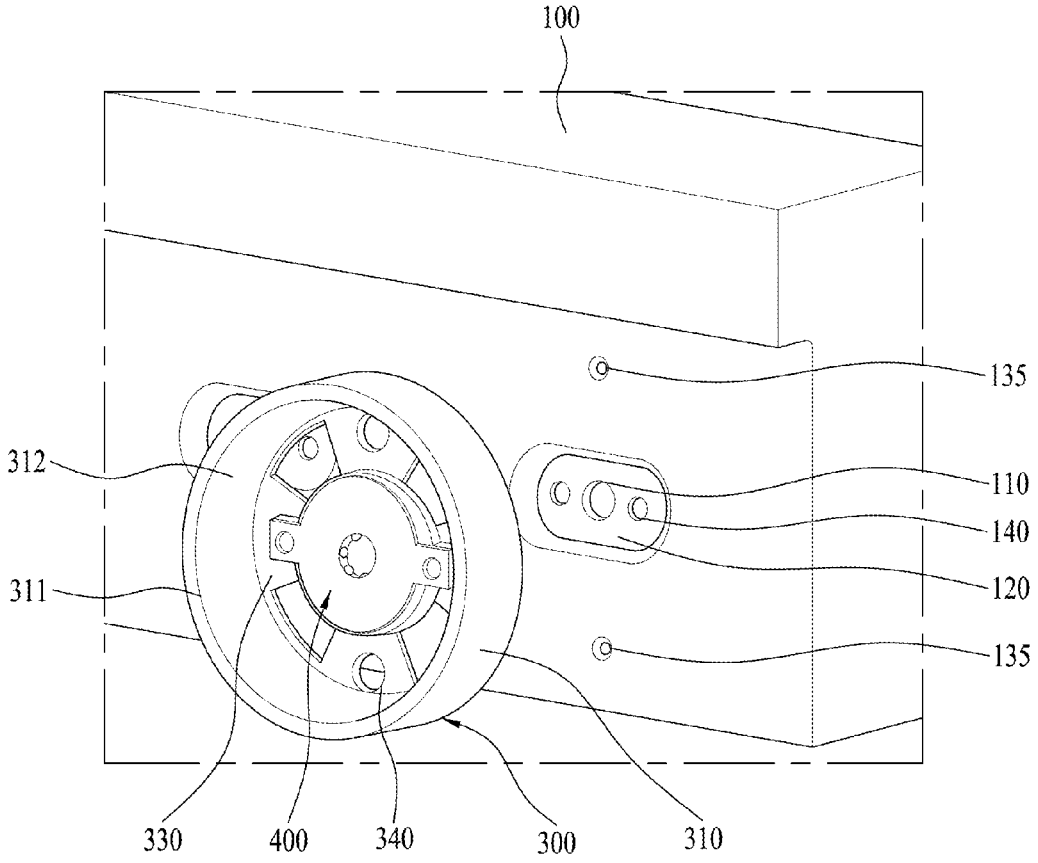
FIG. 5 is an exploded perspective view illustrating a coupling relationship between the panel and a knob-ring depicted in FIG. 4.

Hereinafter, the coupling structure between the panel 100 and the knob-ring 300 will be explained with reference to FIG. 5. FIG. 5 is an exploded perspective view illustrating a coupling relationship between the panel and a knob-ring depicted in FIG. 4. That is, FIG. 5 is an exploded perspective view illustrating the coupling structure between the panel 100 and the knob-ring 300.

The bearing 400 may be coupled to the knob-ring 300, and the knob-ring 300 and the bearing 400 may be integrally coupled to the panel 100. The knob-ring 300 may include a frame 310, which has an opening 311 formed in a front portion thereof and accommodates at least a portion of the knob 200 therein, and a rear wall 320, which is provided at a rear portion of the frame 310. An inner peripheral surface 312 of the frame 310 may be formed such that an inner diameter thereof gradually decreases in a rearward direction, which will be described hereinafter. The rear portion of the frame 310 may be in contact with the panel 100. The rear wall 320 may also be in contact with the panel 100.

The rear wall 320 may be formed with a coupling portion 340 to couple the knob-ring 300 to the panel 100. The coupling portion 340 may be a screw hole, for example. The panel 100 may be formed with a hole 135 corresponding to the screw hole.

A plurality of the coupling portion 340 and a plurality of the hole 130 may be provided. When the plurality of coupling portions 340 and the plurality of holes 135 in the panel 100 are aligned with each other, the through-hole 110 may be located at a center of the knob-ring 300.

As described above, the through-hole 110 may be formed in the center of the recess 120, and one or more gasket coupling hole 140 may be formed around the through-hole 110 in the recess 120. A gasket (not shown) may be secured to the recess 120, such that a portion of the gasket is inserted into the gasket coupling hole(s) 140.

Figure 6:
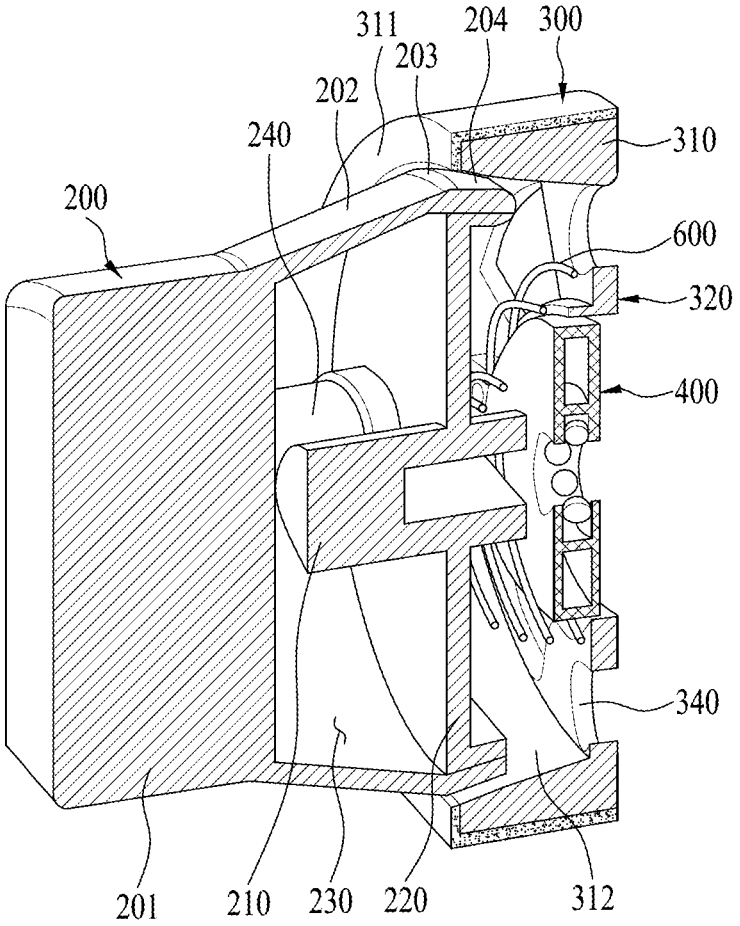
FIG. 6 is a sectional perspective view illustrating a coupling relationship between a knob and the knob-ring depicted in FIG. 4.

Hereinafter, the coupling structure between the knob 200 and the knob-ring 300 will be explained with reference to FIG. 6. FIG. 6 is a sectional perspective view illustrating a coupling relationship between the knob and a knob-ring depicted in FIG. 4. That is, FIG. 6 is a sectional view illustrating the state in which the knob 200 and the knob-ring 300 are coupled.

As described above, the knob-ring 300 may include the ring-shaped frame 310 and the rear wall 320. The inner diameter of the inner peripheral surface 312 of the frame 310 may gradually decrease in the rearward direction.

The knob 200 may include a grip portion 201 formed in a front portion thereof, and a body 202 formed behind the grip portion 201. When the grip portion 201 extends in the vertical direction, the gas valve is in a closed state. The grip portion 201 may be formed in a rectangular parallelepiped shape.

The body 202, which may be formed behind the grip portion 201, may be formed to have a hollow trapezoid-shaped cross section. The grip portion 201 and the body 202 may be formed integrally with each other.

The body 202 may be formed such that an outer diameter and an inner diameter thereof gradually increase in the rearward direction from the grip portion 201. The body 202 may include a maximum diameter portion 203, at which the outer diameter is maximized. The maximum diameter portion 203 may correspond to the opening 311 formed in the front portion of the knob-ring 300. Therefore, when the gas valve is in a closed state, that is, when the cooking appliance is not being used, the maximum diameter portion 203 may be kept in contact with the opening 311 of the knob-ring 300. Accordingly, the gap between the knob 200 and the knob-ring 300 may be minimized.

The body 202 may include a body end portion 204, at which the outer diameter gradually decreases in the rearward direction from the maximum diameter portion 203. The body end portion 204 may be formed corresponding to the inner peripheral surface 312 of the knob-ring 300, whose inner diameter gradually decreases in the rearward direction.

As the knob 200 moves forward, the maximum diameter portion 203 moves into the knob-ring 300. At this time, the maximum diameter portion 203 comes into contact with the inner surface of the knob-ring 300, and is prevented from moving further forward. As the maximum diameter portion 203 and the inner peripheral surface 312 of the knob-ring 300 are formed in a ring shape, restriction of movement at a specific portion therebetween may be prevented. The knob 200 and the inner peripheral surface 312 of the knob-ring 300 may be in contact with each other over the entire ring-shaped area.

The body end portion 204 of the knob 200 may be provided with a knob rear wall 220. The knob rear wall 220 may be fitted in the body end portion 204. The shaft coupling portion 210 may extend in the forward and backward direction from a center of the knob rear wall 220.

The knob rear wall 220 coupled to the body 202 may define a space 230 in the body 202. A boss 240 may be provided near the shaft coupling portion 210. The boss 240 may extend in the forward direction from the knob rear wall 220. The boss 240 may prevent the knob rear wall 220 from moving further into the body 202. In other words, a position at which the knob rear wall 220 is coupled to the body 202 may be determined by the boss 240. A plurality of the boss 240 may be provided, which may be arranged symmetrically to each other around the shaft coupling portion 210. For example, a pair of the boss 240 may be provided.

Because of the shape of the body end portion 204 of the knob 200 and the shape of the inner peripheral surface 312 of the knob-ring 300, as described above, the distance by which the knob 200 can move in the forward direction may be limited.

A spring 600 may be provided between the knob 200 and the knob-ring 300. The spring 600 may be a coil spring, which generates an elastic restoring force with respect to a displacement in a longitudinal direction. In addition, the coil spring may function to prevent the knob 200 from being separated from the knob-ring 300.

In particular, a first end of the spring 600 may be secured to the knob-ring 300, and a second end of the spring 600 may be secured to the knob 200. Thus, the knob 200 may be separated from the knob-ring 300 only if the portions which are connected with the spring 600 are damaged or the spring 600 is subjected to a large displacement. For this reason, the knob 200 may be securely prevented from being separated from the knob-ring 300. The knob 200 may be movably coupled to the knob-ring 300 due to tension of the spring 600. If a force by which the knob 200 is moved in the forward direction is removed, the knob 200 may be returned to its original position by the spring 600.

The knob-ring 300 may be non-movably secured to the panel 100. The knob 200 may be movably mounted to the panel 100 through the knob-ring 300.

The knob 200 may be movably coupled to the knob-ring 300 by the valve shaft 530 as well as the tension of the spring 600. Thus, the knob 200 may be separated from the knob-ring 300 if the knob 200 is subjected to a force stronger than the tension of the spring 600 plus the engagement force between the valve shaft 530 and the shaft coupling portion 210. From a different point of view, the knob 200 may be separated from the knob-ring 300 if the knob 200 is subjected to a force stronger than the tension of the spring 600 plus the force required to separate the valve shaft 530 from the valve main body 505. This means that the knob 200 is securely coupled to the knob-ring 300. Of course, the knob 200 may move in the forward and backward direction and rotate with respect to the knob-ring 300.

Figure 7:
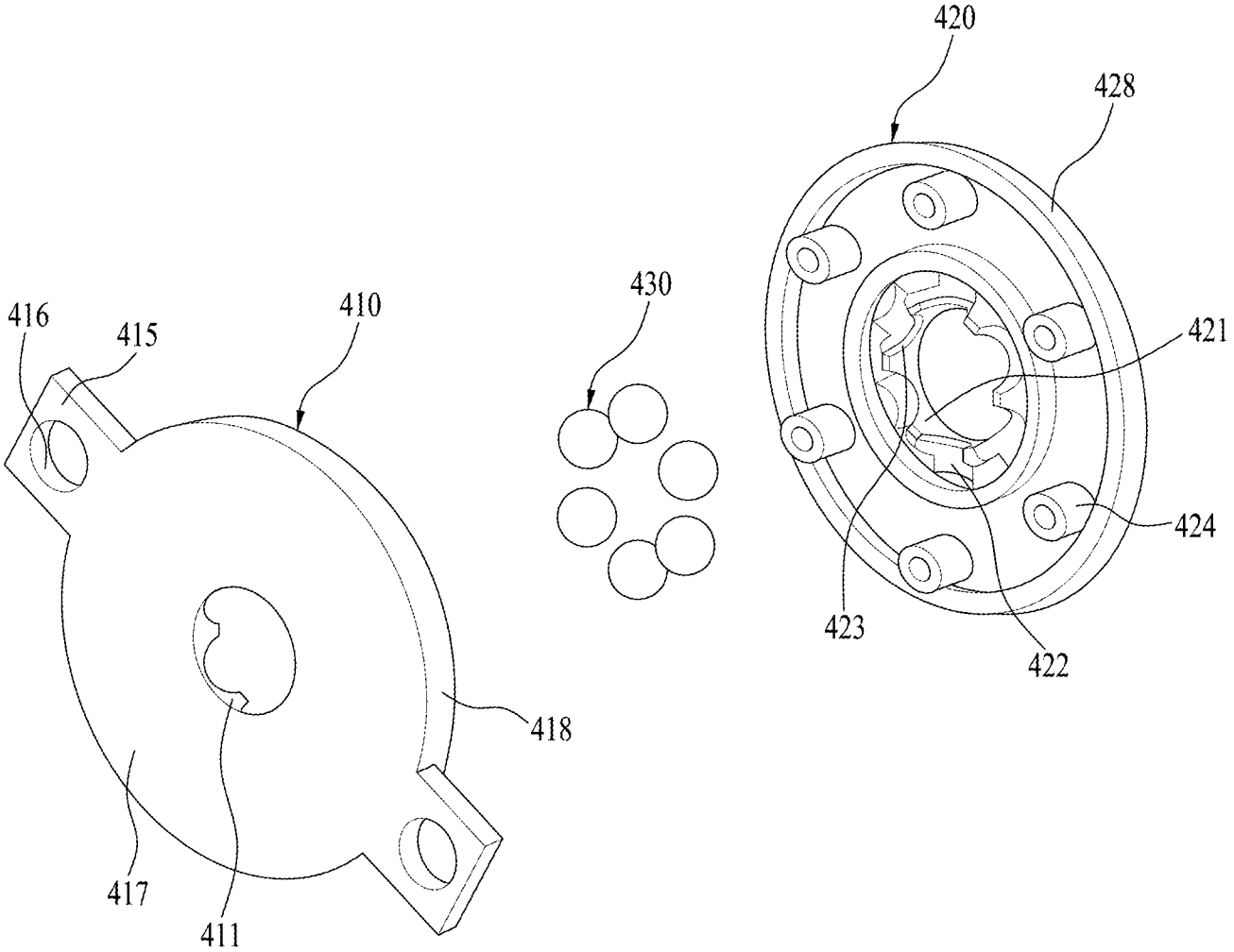
FIGS. 7 and 8 are exploded perspective views of a bearing depicted in FIG. 4.
Figure 8:
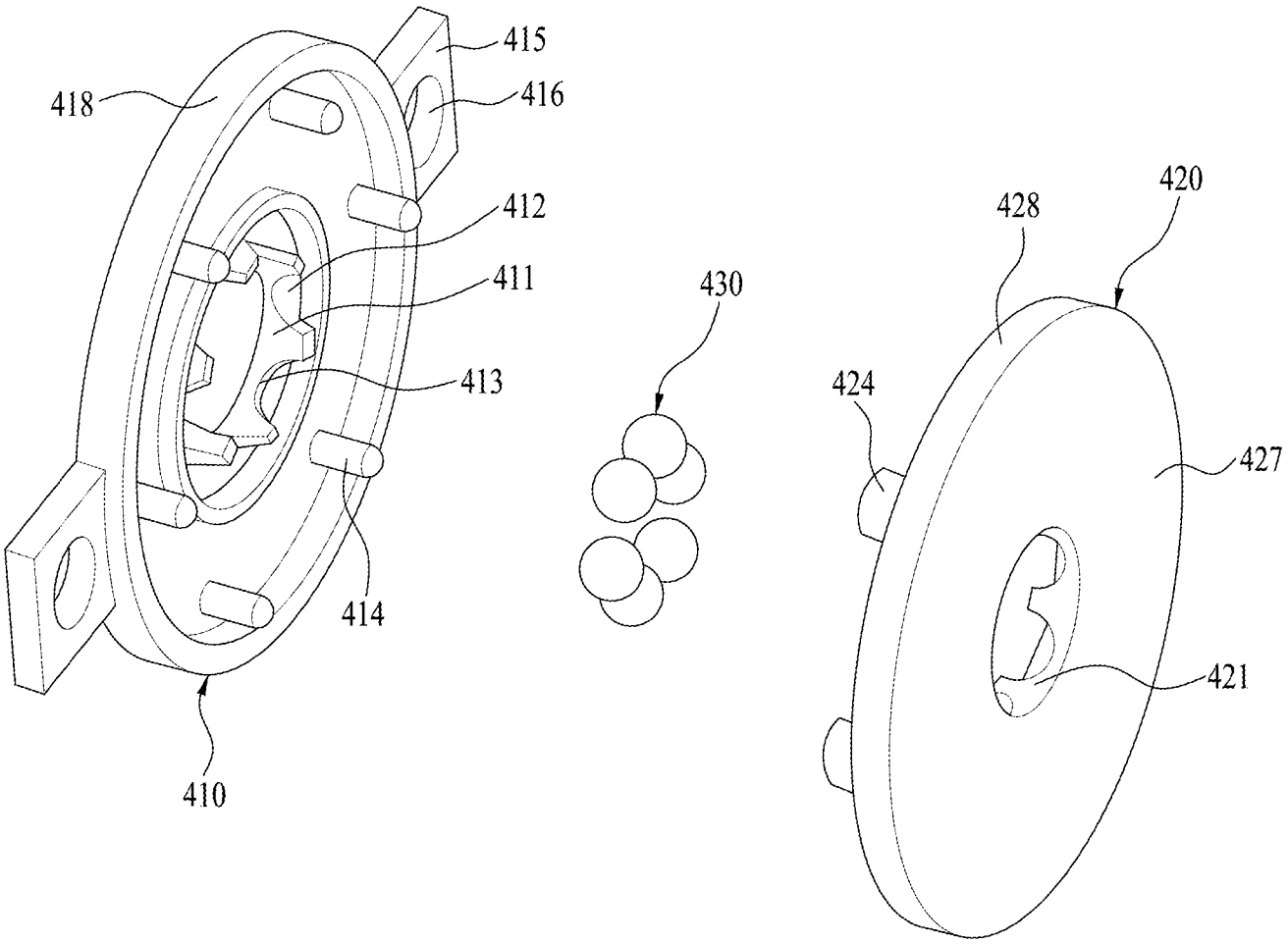

Hereinafter, the bearing 400 will be explained with reference to FIGS. 7 and 8. FIGS. 7 and 8 are exploded perspective views of a bearing depicted in FIG. 4. The bearing 400 may include a bearing housing 410 and 420, and a plurality of balls 430 accommodated in the bearing housing 410 and 420.

The bearing housing 410 and 420 may include inner peripheral surfaces 411 and 421 and outer peripheral surfaces 418 and 428. The inner peripheral surfaces 411 and 421 may be formed with a plurality of ball openings 413 and 423. A portion of the plurality of balls 430 accommodated in the bearing housing 410 and 420 may be exposed in a central direction from the inner peripheral surfaces 411 and 421 through the plurality of ball openings 413 and 423.

In particular, the bearing housing may include a front housing 410 and a rear housing 420. The front housing 410 and the rear housing 420 may be coupled to each other so as to accommodate the plurality of balls 430 therein.

The front housing 410 and the rear housing 420 may be provided with one or more coupling hole 424 and one or more coupling protrusion 414 for engagement therebetween. If the coupling hole is provided in one of the housings, the coupling protrusion, configured to be inserted into the coupling hole, may be provided in the other housing.

The bearing housing 410 and 420 may be formed with a plurality of ball accommodating portions 412 and 422 to accommodate the plurality of balls 430 therein. Positions of the plurality of balls 430 may be determined by the plurality of ball accommodating portions 412 and 422, and the plurality of balls 430 may roll in any direction in a state in which the plurality of balls 430 are kept in the determined positions.

The plurality of ball openings 413 and 423 may have an inner diameter smaller than a diameter of the plurality of balls 430. Accordingly, a portion of the plurality of balls 430 exposed through the plurality of ball openings 413 and 423 may be less than half of an entire spherical surface of the plurality of balls 430. The plurality of balls 430 exposed through the plurality of ball openings 413 and 423 may form an imaginary through-hole, which may have an inner diameter smaller than a diameter of the inner peripheral surfaces 411 and 421 of the bearing housing 410 and 420. The valve shaft 530 may penetrate the imaginary through-hole defined by the plurality of balls 430, and may be supported thereby.

The front housing 410 may include the front surface 417 and a side surface (outer peripheral surface) 418. The rear housing 420 may include a rear surface 427 and a side surface (outer peripheral surface) 428. When the front housing 410 and the rear housing 420 are coupled, an internal space may be formed therein. The front housing 410 and the rear housing 420 may be formed in a ring shape.

The side surfaces (outer peripheral surfaces) 418 and 428 of the front housing 410 and the rear housing 420 may have a predetermined length extending forward and backward. The length of the side surfaces 418 and 428 is important for securing the bearing housing, which will be described hereinafter. The front housing 410 may be formed with one or more fixing portion 416 to secure the bearing housing to the knob-ring 300. The fixing portion 416 may be a screw hole, for example.

The front housing 410 may include one or more fixing rib 415 that extends outwardly in a radial direction from the front surface 417 thereof. A pair of the fixing rib 415 may be provided, which may be arranged symmetrically to each other. The fixing portion 416 may be formed in the fixing rib 415.

The fixing rib 415 may have a width in the forward and backward direction which is smaller than a width of the side surface 418 of the front housing 410, which will be described hereinafter.

Figure 9:
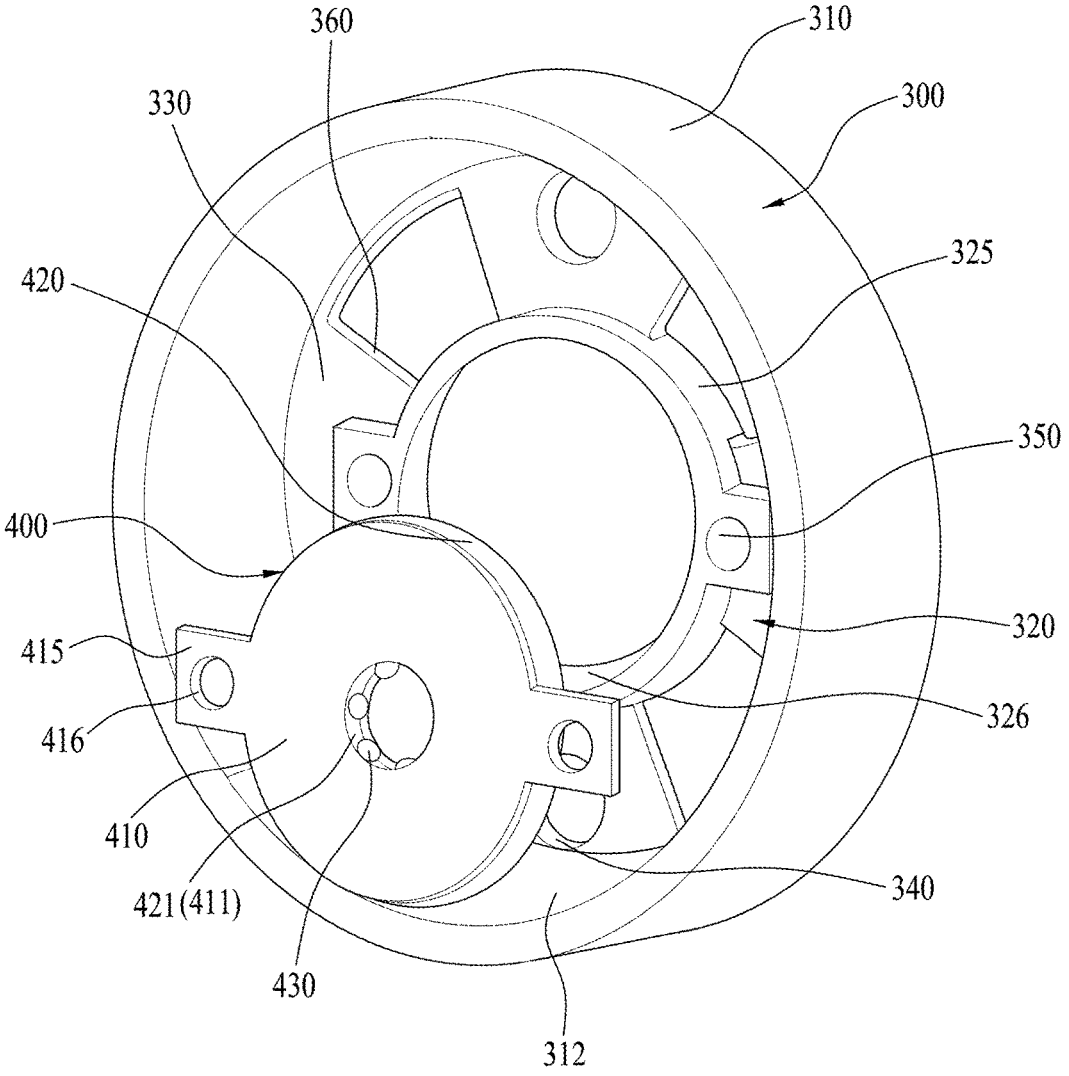
FIG. 9 is an exploded perspective view illustrating a coupling relationship between the knob-ring and the bearing depicted in FIG. 4.
Figure 10:
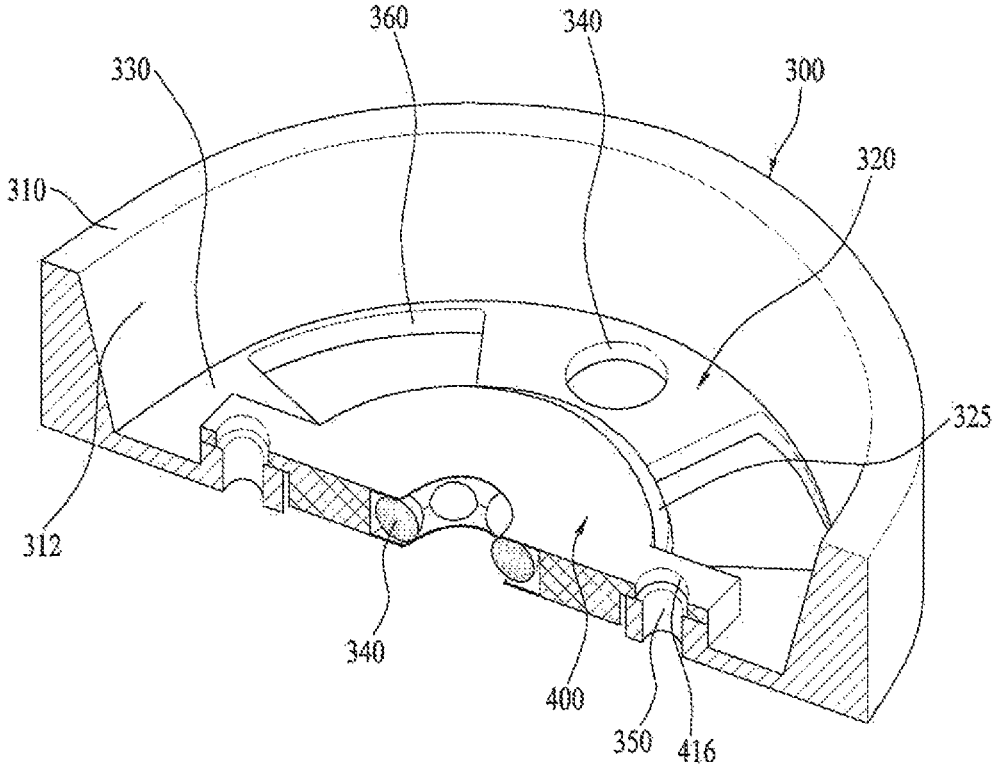
FIG. 10 is a sectional perspective view illustrating a coupling relationship between the knob-ring and the bearing depicted in FIG. 4.

Hereinafter, the structure of the knob-ring and the coupling structure between the knob-ring and the bearing will be explained with reference to FIGS. 9 and 10. FIG. 9 is an exploded perspective view illustrating a coupling relationship between the knob-ring and the bearing depicted in FIG. 4. FIG. 10 is a sectional perspective view illustrating a coupling relationship between the knob-ring and the bearing depicted in FIG. 4.

The knob-ring 300 may have a circle-shaped rib 325 which may be formed in a center of the rear wall 320 thereof. The rib 325 may form a bearing housing insertion portion 326 into which the bearing housing may be inserted. The rib 325 may have a predetermined width in the forward and backward direction which may closely contact at least a portion of the width in the forward and backward direction of the bearing housing. Accordingly, distortion or eccentric bias of the bearing housing inserted into the bearing housing insertion portion 326 may be prevented.

The rear wall 320 may include an extending portion 330, which may extend in the radial direction from the circle-shaped rib 325, that is, the bearing housing insertion portion 326, and may be connected with the frame 310. The extending portion 330 may be formed with one or more cut-out portion 360. A plurality of the cut-out portion 360 may be provided, which may be arranged symmetrically to each other in a circumferential direction. The plurality of cut-out portions 360 may function to enhance an efficiency with which the knob-ring 300 or the rear wall 360 is manufactured, for example, through an injection molding method.

The extending portion 330 may be formed with one or more coupling portion 350 to couple the bearing housing to the knob-ring 300. The coupling portion 350 may be a screw hole, for example.

The coupling portion 350 may correspond to the fixing portion 416 of the bearing housing. Therefore, the object to which the bearing housing is secured may be the knob-ring 300, and the bearing housing may be secured to the panel 100 through the knob-ring 300.

The coupling portion 350 may protrude further in the forward direction than the extending portion 330. This may ensure a sufficient distance for screw engagement.

A process of assembling the knob structure will now be explained.

First, as shown in FIGS. 7 and 8, the bearing 400 may be assembled. Then, as shown in FIGS. 9 and 10, the bearing 400 may be secured to the knob-ring 300. Next, as shown in FIG. 5, the bearing 400 and the knob-ring 300 may be integrally secured to the panel 100.

After the knob-ring 300 is secured to the panel 100, the knob 200 may be coupled to the knob-ring 300. The spring 600 may be interposed between the knob-ring 300 and the knob 200, such that both ends of the spring 600 may be respectively secured thereto, thereby pushing the knob 200 forward from the opening 311 of the knob-ring 300. At this time, the valve shaft 530 may be coupled to the shaft coupling portion 210 of the knob 200. In particular, the front end portion 550 of the valve shaft 530 may be press-fitted into the press-fitting hole 211. A state in which the knob assembly process is completed is illustrated in FIGS. 2 and 4.

As is apparent from the above description, the cooking appliance according to embodiments is capable of preventing restriction of movement of the knob and the valve shaft. In addition, the cooking appliance according to embodiments is capable of preventing deformation or eccentric bias of the valve shaft.

Further, the cooking appliance according to embodiments is capable of preventing restriction of movement of the knob even if the valve shaft is eccentrically biased during an assembly process. Furthermore, the cooking appliance according to embodiments is capable of preventing restriction of movement of the knob even if a relatively heavy knob is used.

Additionally, the cooking appliance according to embodiments can be easily and simply assembled. Also, the cooking appliance according to embodiments is capable of minimizing wobble of the valve shaft and wobble of the knob using a bearing configured to provide a secure support point for the valve shaft so as to stably support rotation and forward-backward movement of the valve shaft. Additionally, the cooking appliance according to embodiments has improved reliability and durability.

Accordingly, embodiments disclosed herein are directed to a cooking appliance that substantially obviates one or more problems due to limitations and disadvantages of the related art.

Embodiments disclosed herein provide a cooking appliance capable of preventing restriction of movement of a knob and a valve shaft. Embodiments disclosed herein further provide a cooking appliance capable of preventing deformation or eccentric bias of a valve shaft. Embodiments disclosed herein also provide a cooking appliance capable of preventing restriction of movement of a knob even if a valve shaft is eccentrically biased during an assembly process.

Further, embodiments disclosed herein provide a cooking appliance capable of preventing restriction of movement of a knob even if a relatively heavy knob is used. Furthermore, embodiments disclosed herein provide a cooking appliance that can be easily and simply assembled.

Additionally, embodiments disclosed herein provide a cooking appliance, in which rotation and forward-backward movement of a valve shaft is stably supported by a bearing configured to provide a secure support point for the valve shaft, thereby minimizing wobble of the valve shaft and wobble of a knob. Also, embodiments disclosed herein provide a cooking appliance having improved reliability and durability.

Embodiments disclosed herein provide a cooking appliance that may includes a cabinet that forms an outer appearance thereof, a cooking unit or device provided at or in the cabinet and configured to cook food or other items using a gas flame, a panel formed with a through-hole, a gas valve provided behind the panel and including a valve shaft that penetrates the through-hole and extends ahead of or in a forward direction from the panel, a knob provided in front of the panel to be connected with the valve shaft and configured to cause rotation and forward-backward movement of the valve shaft through a user's manipulation, and a bearing secured between the knob and the panel and configured to support a circumference of the valve shaft in order to prevent restriction of movement of the knob and the valve shaft. The knob may be provided to ignite or extinguish gas or adjust a flame intensity. A user may ignite or extinguish gas or adjust the flame intensity by manipulating the knob.

The bearing may include a bearing housing and a plurality of balls accommodated in the bearing housing. The bearing housing may be secured between the knob and the panel. The balls may function to support a circumference of the valve shaft in order to allow forward-backward movement and rotation of the valve shaft.

The cooking appliance may be a household appliance using gas, and may be at least one of a gas oven, a gas range, or a gas oven range.

The cooking appliance may further include a knob-ring provided between the knob and the panel and configured to accommodate at least a portion of the knob therein. The knob-ring may function to improve aesthetic appearance of the panel and prevent moisture or foreign materials from being introduced between the knob and the panel.

The knob-ring may include a frame having an opening formed in a front portion thereof and accommodating at least a portion of the knob therein, and a rear wall provided at a rear portion of the frame. An inner peripheral surface of the frame may be formed such that an inner diameter thereof gradually decreases in a rearward direction.

The rear wall may include a bearing housing insertion portion, which may be formed in a center thereof and into which the bearing housing is inserted, and an extending portion which extends in a radial direction from the bearing housing insertion portion and is connected with the frame.

The knob-ring may be secured to the panel. Therefore, the bearing may be secured to the panel through the knob-ring. The bearing may be more securely secured to the knob-ring by the bearing housing insertion portion.

The extending portion may be formed with a coupling portion to couple the knob-ring to the panel. The coupling portion may be a screw hole or bolt hole, for example.

The extending portion may be formed with a coupling portion to couple the bearing housing to the knob-ring. The coupling portion may be a screw hole or bolt hole. The coupling portion may have a width in a forward and backward direction which is greater than that of the extending portion. This may ensure a sufficient distance for screw or bolt engagement. The coupling portion may protrude further forward than the extending portion.

The bearing housing insertion portion may include a circle-shaped rib which may protrude forward in order to surround the bearing housing. The extending portion may extend from the circle-shaped rib in a radial direction and may be connected with the frame.

The bearing housing may include ball accommodating portions to accommodate the balls therein, and ball openings which may be smaller than a diameter of the balls. A portion of the balls, which may be less than half of an entire spherical surface of the balls, may be exposed to the outside of the bearing housing so as to support the valve shaft.

The bearing housing may include a front housing, and a rear housing coupled to the front housing. The ball accommodating portions and the ball openings may be formed in the front housing and the rear housing.

The front housing may be formed with a fixing portion to secure the bearing housing to an object. The object may be the knob-ring.

The fixing portion may be formed in a fixing rib that extends in the radial direction from a front surface of the front housing. The fixing rib may have a width in the forward and backward direction that is smaller than that of the front housing. Therefore, a large portion of the side surface of the bearing housing may be inserted into the bearing housing insertion portion.

The valve shaft may include a rear end portion that passes through a hollow shaft accommodating portion and has a circle-shaped cross section, a front end portion which may be coupled to the knob and has a cross section formed in a partially-cut circle shape, and a middle portion which may be located between the rear end portion and the front end portion and has a circle-shaped cross section. The middle portion of the valve shaft may penetrate the bearing, and the bearing may be configured to support a circumference of the middle portion. A support point, at which the bearing supports the valve shaft, may be located in front of the panel.

The knob may be formed with a shaft coupling portion in which the front end portion of the valve shaft may be press-fitted, and a predetermined gap may be formed between a rear end surface of the shaft coupling portion and a front surface of the bearing housing.

Embodiments disclosed herein provide a cooking appliance that may include a cabinet that forms an outer appearance thereof, a cooking unit or device provided at or in the cabinet and configured to cook food or other items using a gas flame, a panel integrally provided with the cabinet or removably coupled to the cabinet so that a front portion thereof is exposed to the outside, and formed with a through-hole, a gas valve provided behind the panel and including a valve shaft which penetrates the through-hole and extends ahead of or in a forward direction from the panel, a knob provided in front of the panel to be connected with the valve shaft in order to ignite or extinguish gas or adjust a flame intensity, and configured to cause rotation and forward-backward movement of the valve shaft through a user's manipulation, a knob-ring provided between the knob and the panel and configured to accommodate a rear portion of the knob therein, and a bearing secured in the knob-ring and configured to support a circumference of the valve shaft behind the knob in order to allow rotation and forward-backward movement of the valve shaft, thereby preventing restriction of movement of the knob and the valve shaft. The bearing may be a ball bearing. The ball bearing may include a bearing housing secured in the knob-ring, and a plurality of balls accommodated in the bearing housing and configured to support a circumference of the valve shaft in order to allow forward-backward movement and rotation of the valve shaft. The panel may have a recess formed around the through-hole, and a gasket may be seated in the recess.

The cooking appliance may further include a spring provided between the knob and the knob-ring and configured to generate an elastic restoring force with respect to forward-backward movement of the knob. Both ends of the spring may be respectively secured to the knob and the knob-ring. Therefore, the knob and the knob-ring may be coupled to each other by tension of the spring. Even if the knob is pulled backward, as the both ends of the spring are respectively secured to the knob and the knob-ring, the tension of the spring may prevent the knob from being separated from the knob-ring.

The knob-ring may have an inner diameter that gradually decreases in a rearward direction, and the knob may be configured to move forward and backward and rotate in the knob-ring. The knob may be made from an aluminum material or zinc material, and the valve shaft may be arranged substantially horizontally. For this reason, the knob may be disposed on the front surface of the cooking appliance, thereby enhancing convenience in use. Further, as it feels heavy for the user to manipulate the knob, children cannot easily manipulate the knob, and the cooking appliance makes a more luxurious impression overall. In spite of the increase in weight of the knob, as restriction of movement of the knob or the valve shaft may be prevented through a simple structure, the cooking appliance may be easily manufactured.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance, comprising:

a cabinet that forms an outer appearance of the cooking appliance;

at least one cooking device provided in the cabinet to cook items to be cooked using a gas flame;

a panel formed with at least one through-hole;

a gas valve provided behind the panel and including a valve shaft that penetrates the at least one through-hole and extends in a forward direction from the panel;

a knob provided in front of the panel to be connected with the valve shaft, that causes rotation and forward-backward movement of the valve shaft through a user's manipulation;

a knob-ring provided between the knob and the panel, that accommodates at least a portion of the knob therein; and a bearing secured between the knob and the panel, that supports a circumference of the valve shaft in order to prevent restriction of movement of the knob and the valve shaft, the bearing including a bearing housing coupled with the knob-ring and housing a plurality of balls, wherein the knob-ring includes:

a frame having an opening formed in a front portion thereof, that accommodates at least a portion of the knob therein; and a rear wall provided at a rear portion of the frame and including a bearing housing insertion portion, which is formed in a center of the rear wall and into which the bearing housing of the bearing is inserted through the opening of the frame and installed, the rear wall being installed at a front side of the panel, and wherein the bearing housing insertion portion has a width in a forward and backward direction which closely contacts a width of the bearing housing to prevent distortion or bias of the bearing housing inserted into the bearing housing insertion portion.

2. The cooking appliance according to claim 1, wherein the bearing housing is secured between the knob and the panel, and the plurality of balls is accommodated in the bearing housing and supports the circumference of the valve shaft in order to allow the forward-backward movement and the rotation of the valve shaft.

3. The cooking appliance according to claim 2, wherein the bearing housing includes a plurality of ball accommodating portions to accommodate the plurality of balls therein, and a plurality of ball openings, each of which is smaller than a diameter of one of the plurality of balls, and wherein a portion of each of the plurality of balls, which is less than half of an entire spherical surface of each of the plurality of balls, is exposed to an outside of the bearing housing so as to support the valve shaft.

4. The cooking appliance according to claim 3, wherein the bearing housing includes a front housing, and a rear housing coupled to the front housing, and wherein the plurality of ball accommodating portions and the plurality of ball openings are formed in the front housing and the rear housing.

5. The cooking appliance according to claim 4, wherein the front housing is formed with at least one fixing portion to secure the bearing housing to the knob-ring.

6. The cooking appliance according to claim 5, wherein the fixing portion is formed in a fixing rib that extends in a radial direction from a front surface of the front housing.

7. The cooking appliance according to claim 6, wherein the fixing rib has a width in a forward to backward direction which is smaller than a width of the front housing.

8. The cooking appliance according to claim 1, wherein the rear wall further includes an extending portion that extends in a radial direction from the bearing housing insertion portion and is connected with the frame.

9. The cooking appliance according to claim 8, wherein the extending portion is formed with at least one coupling portion to couple the knob-ring to the panel.

10. The cooking appliance according to claim 8, wherein the extending portion is formed with at least one coupling portion to couple the bearing housing to the knob-ring.

11. The cooking appliance according to claim 1, wherein the bearing housing insertion portion includes a circle-shaped rib that protrudes in a forward direction in order to surround the bearing housing.

12. The cooking appliance according to claim 1, wherein the valve shaft includes a rear end portion that passes through a hollow shaft accommodating portion of the gas valve and has a circle-shaped cross section, a front end portion which is coupled to the knob and having a cross section formed in a partially-cut circle shape, and a middle portion located between the rear end portion and the front end portion and having a circle-shaped cross section.

13. The cooking appliance according to claim 12, wherein the middle portion of the valve shaft penetrates the bearing, and wherein the bearing that supports a circumference of the middle portion.

14. The cooking appliance according to claim 13, wherein the knob is formed with a shaft coupling portion in which the front end portion of the valve shaft is press-fitted, and wherein a predetermined gap is formed between a rear end surface of the shaft coupling portion and the bearing.

15. A cooking appliance, comprising:

a cabinet that forms an outer appearance of the cooking appliance;

at least one cooking device provided in the cabinet to cook items using a gas flame;

a panel integrally provided with the cabinet or removably coupled to the cabinet so that a front portion thereof is exposed to an outside of the cooking appliance, and formed with at least one through-hole;

a gas valve provided behind the panel and including a valve shaft that penetrates the at least one through-hole and extends in a forward direction from the panel;

a knob provided in front of the panel to be connected with the valve shaft in order to ignite or extinguish gas or adjust a flame intensity, that causes rotation and a forward-backward movement of the valve shaft through a user's manipulation;

a knob-ring provided between the knob and the panel, that accommodates a rear portion of the knob therein, the knob-ring being installed at a front side of the panel;

a bearing secured in the knob-ring, that supports a circumference of the valve shaft behind the knob in order to allow the rotation and the forward-backward movement of the valve shaft, thereby preventing restriction of movement of the knob and the valve shaft, the bearing including a bearing housing coupled with the knob-ring; and a spring provided between the knob and the knob-ring, that generates an elastic restoring force with respect to forward-backward movement of the knob, wherein ends of the spring are respectively secured to the knob and the knob-ring, wherein the knob-ring includes a bearing housing insertion portion having a width in a forward and backward direction which closely contacts a width of the bearing housing to prevent distortion or eccentric bias of the bearing housing inserted into the bearing housing insertion portion.

16. The cooking appliance according to claim 15, wherein the knob-ring has an inner diameter that gradually decreases in a rearward direction, and wherein the knob is configured to move forward and backward and rotate in the knob-ring.

17. The cooking appliance according to claim 15, wherein the knob is made from an aluminum material or zinc material, and wherein the valve shaft is arranged substantially horizontally.

18. A panel assembly for a cooking appliance, comprising:

a panel formed with at least one through-hole;

a gas valve provided behind the panel and including a valve shaft that penetrates the at least one through-hole and extends in a forward direction from the panel;

a knob provided in front of the panel to be connected with the valve shaft, that causes rotation and forward-backward movement of the valve shaft through a user's manipulation;

a knob-ring provided between the knob and the panel, that accommodates at least a portion of the knob therein; and a bearing secured between the knob and the panel, that supports a circumference of the valve shaft in order to prevent restriction of movement of the knob and the valve shaft, the bearing including a bearing housing coupled with the knob-ring, wherein the knob-ring includes:

a frame having an opening formed in a front portion thereof, that accommodates at least a portion of the knob therein, and a rear wall provided at a rear portion of the frame and including a bearing housing insertion portion, which is formed in a center of the rear wall and into the bearing housing of the bearing is inserted through the opening of the frame and installed, the rear wall being installed at a front side of the panel, and wherein the bearing housing insertion portion has a width in a forward and backward direction which closely contacts a width of the bearing housing to prevent distortion or eccentric bias of the bearing housing inserted into the bearing housing insertion portion.

19. The panel assembly according to claim 18, wherein the bearing housing is secured between the knob and the panel, and the bearing includes a plurality of balls accommodated in the bearing housing that supports the circumference of the valve shaft in order to allow the forward-backward movement and the rotation of the valve shaft.

20. The panel assembly according to claim 19, wherein the bearing housing includes a plurality of ball accommodating portions to accommodate the plurality of balls therein, and a plurality of ball openings, each of which is smaller than a diameter of one of the plurality of balls, and wherein a portion of each of the plurality of balls, which is less than half of an entire spherical surface of each of the plurality of balls, is exposed to an outside of the bearing housing so as to support the valve shaft.

21. The panel assembly according to claim 18, wherein the rear wall further includes an extending portion that extends in a radial direction from the bearing housing insertion portion and is connected with the frame.

22. The panel assembly according to claim 18, wherein the valve shaft includes a rear end portion that passes through a hollow shaft accommodating portion of the gas valve and has a circle-shaped cross section, a front end portion which is coupled to the knob and having a cross section formed in a partially-cut circle shape, and a middle portion located between the rear end portion and the front end portion and having a circle-shaped cross section.

23. The panel assembly according to claim 22, wherein the middle portion of the valve shaft penetrates the bearing, and wherein the bearing supports a circumference of the middle portion.

24. The panel assembly according to claim 23, wherein the knob is formed with a shaft coupling portion in which the front end portion of the valve shaft is press-fitted, and wherein a predetermined gap is formed between a rear end surface of the shaft coupling portion and the bearing.

25. A cooking appliance including the panel assembly according to claim 18.

* * * * *